US008107634B2

(12) United States Patent
Gratzer et al.

(10) Patent No.: US 8,107,634 B2
(45) Date of Patent: Jan. 31, 2012

(54) HIGH INTENSITY CALIBRATION DEVICE

(75) Inventors: Richard M Gratzer, Fircrest, WA (US); Robert D. Lee, Renton, WA (US); Joel R. Tuss, Federal Way, WA (US); James R. Underbrink, Seattle, WA (US); Wayne F. Wenneman, Auburn, WA (US)

(73) Assignee: The Boeing Company, Chicago, IL (US)

( * ) Notice: Subject to any disclaimer, the term of this patent is extended or adjusted under 35 U.S.C. 154(b) by 648 days.

(21) Appl. No.: 12/258,405

(22) Filed: Oct. 25, 2008

(65) Prior Publication Data

US 2010/0104108 A1 Apr. 29, 2010

(51) Int. Cl.
*H04R 25/00* (2006.01)

(52) U.S. Cl. ..... 381/59; 381/92; 381/58; 381/17; 381/310; 73/585; 73/571; 73/663; 73/1.02; 73/112.01

(58) Field of Classification Search ..... 381/58, 381/59, 92, 310, 17; 73/585, 571, 579, 663, 73/1.02, 112.01
See application file for complete search history.

(56) References Cited

U.S. PATENT DOCUMENTS

| | | | | |
|---|---|---|---|---|
| 4,328,998 | A * | 5/1982 | Manson | 384/18 |
| 5,567,863 | A * | 10/1996 | Larson et al. | 73/1.82 |
| 6,484,580 | B2 * | 11/2002 | Eagen et al. | 73/571 |
| 6,956,955 | B1 * | 10/2005 | Brungart | 381/310 |
| 7,559,234 | B1 * | 7/2009 | Chorpening et al. | 73/112.01 |
| 7,653,425 | B2 * | 1/2010 | Hayter et al. | 600/345 |
| 2001/0032510 | A1 * | 10/2001 | Eagen et al. | 73/571 |
| 2010/0171145 | A1 * | 7/2010 | Morgan et al. | 257/99 |
| 2011/0051950 | A1 * | 3/2011 | Burnett | 381/92 |

FOREIGN PATENT DOCUMENTS

EP 0 553 325 A1 * 8/1992

OTHER PUBLICATIONS

Dynamic Calibration of Low-Range Silicon Pressure Sensors, IEEE Transactions on Instrumentation and Measurement, vol. 51, No. 6, Dec. 2002, p. 1358-1362, Zakrzewski, et al.
Dynamic Pressure Calibration, PCB Piezotronics, Inc., Depew, NY 14043 USA, Technical Note TN-15, Lally et al., www.PCB.com.

* cited by examiner

*Primary Examiner* — A O Williams

(57) ABSTRACT

A calibration device for calibrating a dynamic pressure sensor includes a power/control box and a portable calibration head disposed in electrical communication with the power/control box. The portable calibration head may include a calibration head housing having a housing opening and a speaker provided in the calibration head housing and communicating with the housing opening. The power/control box may be configured to induce emission of an acoustic calibration signal from the speaker of the calibration head.

24 Claims, 6 Drawing Sheets

HIGH INTENSITY CALIBRATION DEVICE

TECHNICAL FIELD

The disclosure relates to calibration of dynamic pressure sensors. More particularly, the disclosure relates to a flexible, ergonomic, robust, high intensity calibration device which has in-the-field calibration and diagnostic capabilities for acoustic test systems.

BACKGROUND

The advent of the aerospace era and advanced weapons development has necessitated the development of high-frequency dynamic pressure sensors for the measurement of shock wave, blast, rocket combustion instability and ballistic parameters. However, piezoelectric sensors, which were originally used for the purpose, have limited frequency response. Miniature, high-frequency acceleration-compensated quartz pressure sensors with microsecond response time have been developed. Development of the quartz pressure sensors has led to shock tube technology which may be used to research aerodynamic shock waves that a spacecraft may encounter during re-entry. Other high-frequency sensors which are tailored for specific applications have been developed. For example, miniature piezoresistive dynamic pressure sensors have been developed and are used for full-scale and model-scale aeroacoustic measurements including measurement of turbulent boundary layers, sonic fatigue, jet noise, fan noise, and shock cell noise.

Along with the development of higher frequency pressure sensors has come the need for dynamic pressure calibration of the sensors. Unique calibration devices have been developed to calibrate high-frequency pressure sensors in a variety of applications. However, some of these calibration devices may have a number of drawbacks. These may include, for example and without limitation, calibration difficulty; ergonomic issues associated with handling, positioning and operation of the device; limitations in the quality and extent of operational feedback; limitations in the number of source level settings; limitation in the maximum source level; and susceptibility to damage of the calibration device if operation is undertaken without a proper seal. The devices may also lack proper design for accommodating alternate sensor adaptors. Moreover, vendor solutions may not be designed for in-situ calibration; may not provide a high frequency level which may be required for some applications; and may be generally very limited in their applicability to many applications. The solutions may not work for flush mount installations and may require disassembly of the sensor installation to apply the calibration signal. Additionally, the vendor solutions may not include the option of selecting a broad-band noise signal and may be very limited in the number of frequencies (typically one) and levels (typically one or two) that may be selected.

Accordingly, there is a need for a high intensity calibration device which may overcome many or all of the drawbacks of conventional pressure sensor calibration devices discussed above.

SUMMARY

The present disclosure is generally directed to a calibration device for calibrating a dynamic pressure sensor. An illustrative embodiment of the calibration device includes a power/control box and a portable calibration head disposed in electrical communication with the power/control box. The portable calibration head may include a calibration head housing having a housing opening and a speaker provided in the calibration head housing and communicating with the housing opening. The power/control box may be configured to induce emission of an acoustic calibration signal from the speaker of said calibration head.

The calibration device may be characterized by enhanced robustness, flexibility and ergonomics and may be amenable to a broad range of applications. The calibration device may also include the option of selecting a broad-band noise signal and may include the option of selecting various frequencies (typically one) and noise levels. The calibration device may be applicable to flush-mount installations or non-flush-mount installations.

BRIEF DESCRIPTION OF THE ILLUSTRATIONS

DETAILED DESCRIPTION

Figure 1:
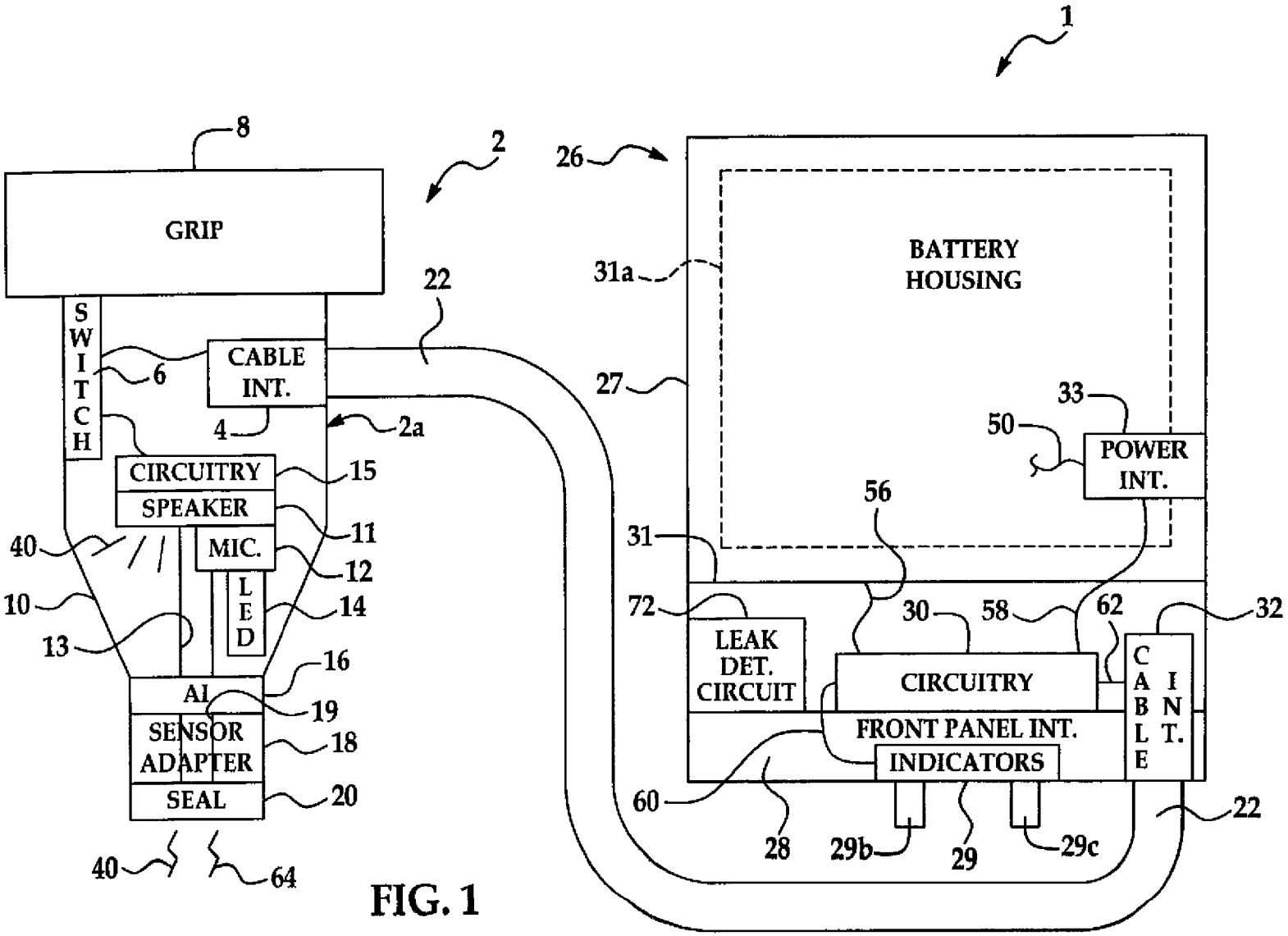
FIG. 1 is a schematic block diagram of an illustrative embodiment of the high intensity calibration device.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure which is defined by the claims. Furthermore, there is no intention to be bound by any expressed or implied theory presented in the preceding technical field, background, brief summary or the following detailed description.

Referring initially to FIGS. 1-9 and 9B of the drawings, an illustrative embodiment of the high intensity calibration device, hereinafter device, is generally indicated by reference numeral 1. The calibration device 1 may include a power/control box 26 and a portable calibration head 2 which is in electrical communication with power/control box 26 and including: a calibration head housing 2*a* with a housing opening 13; a speaker 11 provided in the calibration head housing 2*a* and communicating with the housing opening 13; and wherein the power/control box 26 is configured to induce emission of an acoustic calibration signal 40 from the speaker 11 of the calibration head 2.

As illustrated in FIG. 1, the device 1 may include a portable and ergonomic calibration head 2 and a power/control box 26. The calibration head 2 may be adapted for connection to the power/control box 26 through a connecting cable 22 which may be flexible to render portable the calibration head 2.

Figure 3:
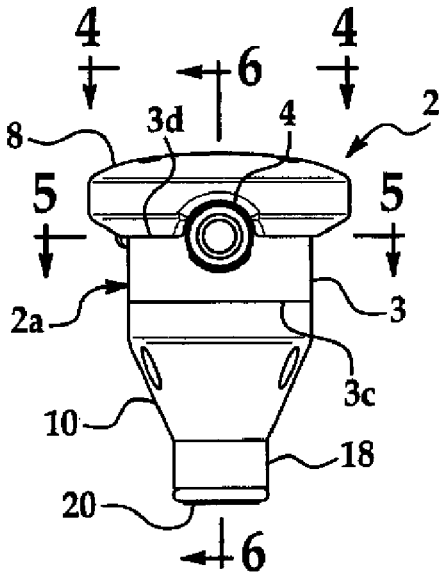
FIG. 3 is a side view of a calibration head of an illustrative embodiment of the high intensity calibration device.
Figure 4:
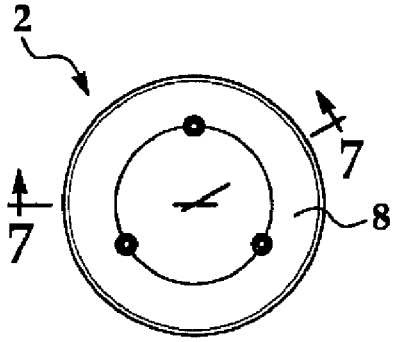
FIG. 4 is a top view, taken along viewing lines 4-4 in FIG. 3, of the calibration head.
Figure 5:
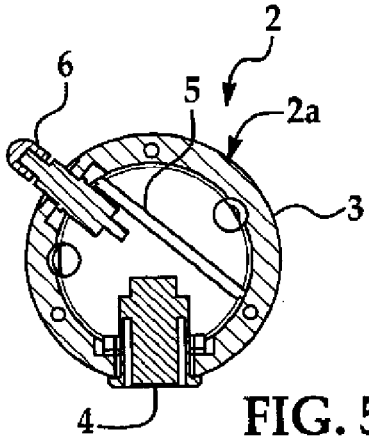
FIG. 5 is a cross-sectional view, taken along section lines 5-5 in FIG. 3, of the calibration head.
Figure 6:
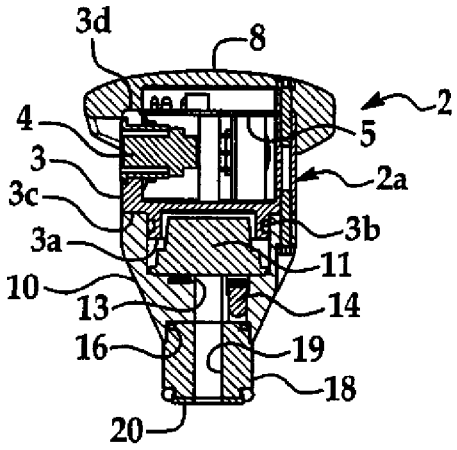
FIG. 6 is a longitudinal sectional view, taken along section lines 6-6 in FIG. 3, of the calibration head.
Figure 7:
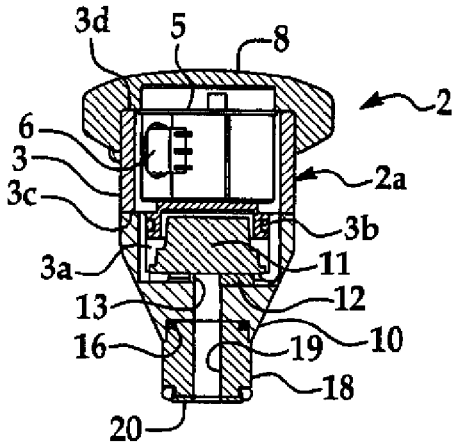
FIG. 7 is a longitudinal sectional view, taken along section lines 7-7 in FIG. 4, of the calibration head.

The calibration head 2 may have a calibration head housing 2*a*. As shown in FIGS. 3, 6 and 7, in some embodiments the calibration head housing 2*a* may include a main housing 3 which may be generally cylindrical and a speaker housing 10 which may extend from a first end 3*c* of the main housing 3 and may be tapered. A generally circular or disc-shaped grip 8 may be provided on a second end 3*d* of the main housing 3. The width or diameter of the grip 8 may be greater than the width or diameter of the main housing 3. As shown in FIGS. 6 and 7, an annular housing flange 3*a* may extend from the main housing 3. The housing flange 3*a* may be inserted in the speaker housing 10. An elastomeric o-ring seal 3*b* may be interposed between the housing flange 3*a* and the speaker housing 10. The speaker housing 10 may have a housing opening 13.

The speaker housing 10 may have an adaptor interface 16. A sensor adaptor 18, having an adaptor opening 19 which registers with the housing opening 13 of the speaker housing 10, may interface with the adaptor interface 16. The sensor adaptor 18 may be a transparent or translucent material. A seal 20 may be provided on the sensor adaptor 18. The sensor adaptor 18 may be adapted to interface with a pressure sensor 37 (FIG. 9) on a surface 36 in calibration of the pressure sensor 37, as will be hereinafter described. The sensor adaptor 18 may have any desired size and shape depending on the particular application of the device 1, which will be hereinafter described. The sensor adaptor 18 may have various designs for flush mount installations and non-flush mount installations. The sensor adaptor 18 may be interchangeable with other sensor adaptors 18 which may vary in configuration and diameter of the adaptor opening 19 to accommodate pressure sensors 37 (FIG. 9) of various sizes and types.

A speaker 11 may be provided in the speaker housing 10 and may communicate with the housing opening 13 of the speaker housing 10. The speaker 11 may be adapted to generate an acoustic calibration signal, as will be hereinafter described. As shown in FIGS. 1 and 7, a microphone 12 may be provided in the speaker housing 10 in proximity to the speaker 11. The microphone 12 may be adapted to provide a feedback signal to facilitate adjustment of the acoustic calibration signal which is broadcasted from the speaker 11. As further shown in FIG. 1, speaker circuitry 15 may be connected to the speaker 11. At least one LED 14 (FIG. 6) may additionally be provided in the speaker housing 10. In some embodiments, multiple LEDs 14 may be positioned circumferentially around the speaker housing 10. The LED 14 or LEDs 14 may provide illumination for assisting an operator in positioning the calibration device 1 over a sensor 37 (FIG. 9) without contacting the sensor 37. In some applications of the calibration device 1, the sensor 37 may be installed in a poorly-lit area and external lighting may be inadequate to illuminate the calibrator/sensor interface due to shadowing from the operator and/or the calibrator head 2. The LED 14 or LEDs 14 may additionally provide visual feedback to an operator in the event that a leak is detected. In this case, the LED 14 or LEDs 14 may be configured to flash in the event that a leak is detected.

In some embodiments, a leak detection circuit 72 (FIGS. 1 and 9B) may be provided in the power/control box 26 to detect leakage in the seal 20. The leak detection circuit 72 may detect whether feedback 84 (FIG. 9B) from the microphone 12 is out of range. A reference signal 40*a* received by the microphone 12 may be compared to the expected level for the calibration signal 40 and adjustments may then be made (such as via the calibration head indicators and controls 29 through an indication signal 86 from the leak detection circuit 72) to the control signal 88 which is provided to drive the speaker 11. If the reference signal 40*a* does not stabilize (compare favorably with the expected level for the calibration signal 40 and stay there) within a predetermined time period, then a leak may be present in the seal 20 because a sealed volume may stabilize quickly. If a leak in the seal 20 is detected, the LED 14 may flash (such as by activation of the LED(s) 14 by the leak detection circuit 72 via an activation signal 90), providing an indication to the operator to adjust the calibrator position via the calibration head indicators and controls 29 and eliminate the leak. In some embodiments, there may also be an automatic shutoff of the speaker 11, via an automatic shutoff signal 92, that may be activated if the leak persists for an extended period of time. This may prevent overdriving of and potential damage to the speaker 11.

A cable interface 4 may be provided in the calibration head housing 2 and may be adapted to interface with the connecting cable 22. A switch 6 may be provided in the calibration head housing 2 and may be electrically connected between the cable interface 4 and the speaker circuitry 15. The switch 6 may be adapted to selectively and reversibly establish electrical communication between the cable interface 4 and the speaker circuitry 15 and the LED 14 (FIG. 6). When power is turned on at the power/control box 26, the speaker circuitry 15 in the calibrator head 2 may be powered. The microphone 12 may additionally be powered. The switch 6 on the calibrator head 2 may energize the LED(s) 14 and activate the drive for the speaker 11 (provide an appropriate signal to the speaker 11 using reference microphone feedback to set the calibrator signal at the appropriate level). An IC card 5 (FIGS. 6 and 7) may additionally be provided in the calibration head housing 2*a* and/or the grip 8.

Figure 2:
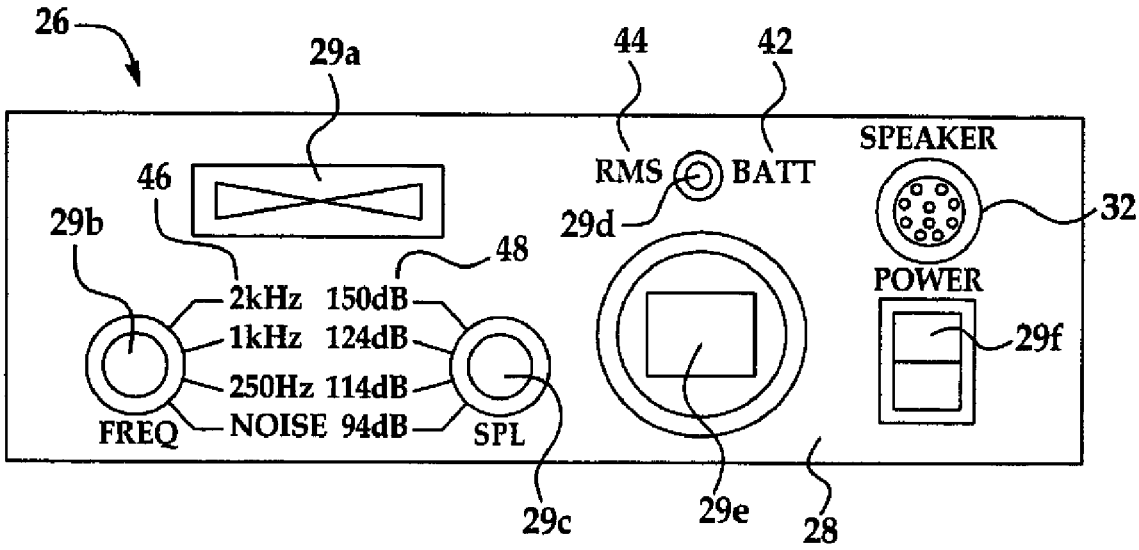
FIG. 2 is a front view of a power box of an illustrative embodiment of the high intensity calibration device.

As further shown in FIG. 1, the power/control box 26 may include a power box housing 27. The power box housing 27 may have a front panel interface 28 with calibration head indicators and controls 29. The calibration head indicators and controls 29 may be adapted to set the type and characteristics of an acoustic calibration signal 40 which is broadcasted from the speaker 11 of the calibration head 2. As shown in FIG. 2, the calibration head indicators and controls 29 may include an indicator 29*a* and an RMS/BATT switch 29*d*. In some embodiments, the indicator 29*a* may be a two-function indicator. When an RMS/BATT switch 29*d* is in the BATT position, the indicator 29*a* may indicate whether the battery 31*a* is charged. When the RMS/BATT switch 29*d* is in the RMS position and the switch 6 on the calibration head 2 is activated, the indicator 29*a* may indicate whether the speaker 11 is delivering the proper acoustic calibration signal. If the indicator 29*a* is at the middle, the proper acoustic calibration signal 40 is being delivered. Positioning of the indicator 29*a* at the left or right of center may indicate that the amplitude of the delivered acoustic calibration signal 40 is lower or higher, respectively, than the proper acoustic calibration signal 40 which should be delivered by the speaker 11. The calibration head indicators and controls 29 may further include a frequency adjustment knob 29*b* which may be adapted to select the frequency of the acoustic calibration signal 40; a volume adjustment knob 29*c* which may be adapted to select the volume of the acoustic calibration signal 40; an RMS/BATT switch 29*d* which in some embodiments may be used to select between a BATT position 42 and an RMS position 44; and a digital indicator 29*e* which may be adapted to present a digital readout of the frequency 46 and/or volume 48 of the acoustic calibration signal 40. The digital indicator 29*e* may be a two-function readout. When the RMS/BATT switch 29*d* is in the BATT position 42, the digital indicator 29*e* may indicate the voltage of the battery 31*a*. When the RMS/BATT switch 29*d* is in the RMS position 44 and the switch 6 on the calibration head 2 is activated, the digital indicator 29*e* may indicate the RMS voltage derived from the microphone feedback 84, ultimately verifying that the speaker 11 is delivering the desired acoustic calibration signal 40. The digital indicator 29*e* may be additionally adapted for readout of frequency, volume and/or other characteristics of the acoustic calibration signal 40. The calibration head indicators and controls 29 may additionally include a power switch 29*f* to facilitate selective turning of the calibration head 2 and the power/control box 26 on and off, for example and without limitation. In some embodiments, the calibration head indicators and controls 29 may additionally provide for selection of a signal type (such as tone or white noise, for example and without limitation. A cable interface 32 which may be adapted to interface with the connecting cable 22 may be provided on the front panel interface 28 or elsewhere on the power box housing 27.

As shown in FIG. 1, a battery housing 31, which may house at least one battery 31*a*, may be provided in the power box housing 27. The battery 31*a* may be a rechargeable battery, for example and without limitation. A power interface 33 may be provided in the power box housing 27. The power interface 33 may be adapted to interface with an AC cord (not shown) for connection to an external AC power source (not shown). The battery 31*a* may be electrically connected 50 to the power interface 33 to receive re-charging electrical power from the power interface 33. Power box circuitry 30 may be electrically connected 56 to the battery 31*a*. In some embodiments, the power box circuitry 30 may also be electrically connected 58 to the power interface 33. The power box circuitry 30 may additionally be connected 60 to the calibration head indicators and controls 29 and electrically connected 62 to the cable interface 32. Accordingly, responsive to input from the calibration head indicators and controls 29, the control circuitry 30 may be adapted to facilitate control of the calibrator head 2 in operation of the device 1 which will be hereinafter described.

Figure 8:
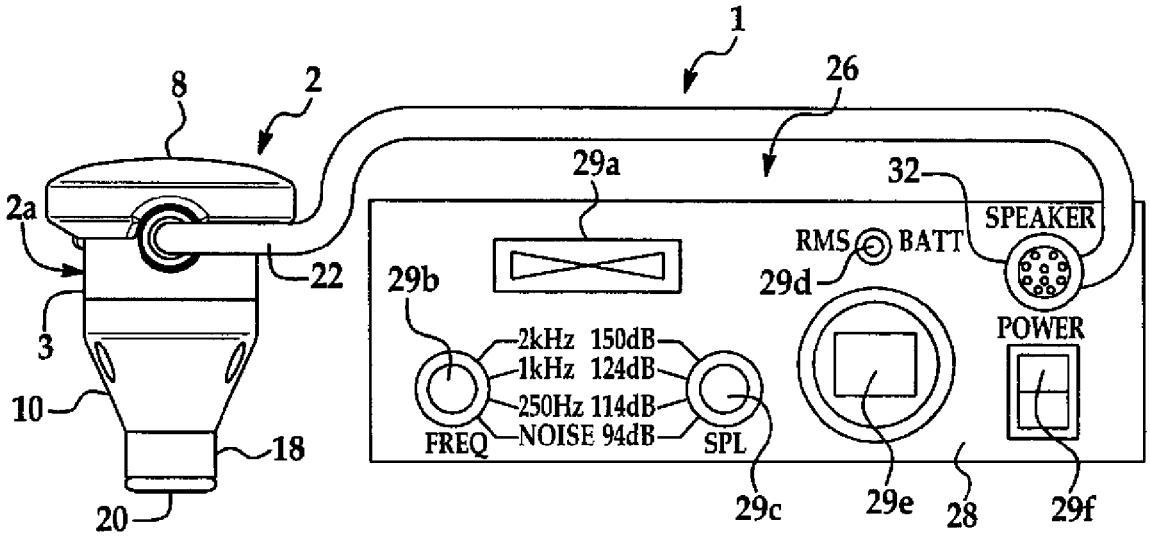
FIG. 8 is a side view of the calibration head and a front view of the power box of an illustrative embodiment of the high intensity calibration device, with a connecting cable (partially in section) connecting the calibration head to the power box in operation of the device.

In typical operation, the device 1 may be used to apply a known sound pressure level in the form of an acoustic calibration signal 40 to a pressure sensor 37 (FIG. 9) which may be provided on a surface 36 in order to calibrate the pressure sensor 37. The device 1 may also allow application of a diagnostic signal 64 (broad band noise) (FIG. 1). Accordingly, the calibration head 2 may be connected to the power/control box 26 by inserting the connecting cable 22 in the cable interface 4 of the calibration head 2, as shown in FIG. 1, and in the cable interface 32 of the power/control box 26, as shown in FIGS. 1 and 8. The connecting cable 22 may be fabricated in various lengths and selected according to the desired distance between the calibration head 2 and the power/control box 26. The sensor adaptor 18 which is attached to the adaptor interface 16 of the calibration head 2 may be selected depending on the type of pressure sensor 37 which is to be calibrated. For example and without limitation, the sensor adaptor 18 may be selected for flush mount installation or non-flush mount installation. For example, for a non-flush installation, an adapter with a tube whose inside diameter matches the outside diameter of a cylindrical sensor may be used. A variety of sizes of adaptors fitted with tubes or other attachments may be made for use with virtually any size/shape of sensor.

Figure 9:
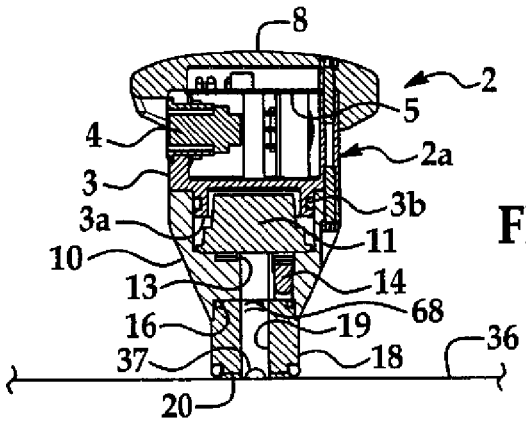
FIG. 9 is a sectional view of the calibration head, placed over a pressure sensor provided on a surface in calibration of the pressure sensor.

As an operator (not shown) grips and holds the calibration head 2, the sensor adaptor 18 may be placed over the pressure sensor 37, as shown in FIG. 9, with the pressure sensor 37 located in the adaptor opening 19 of the sensor adaptor 18. The seal 20 may engage the portion of the surface 36 which surrounds the pressure sensor 37 to eliminate the presence of an air gap between the sensor adaptor 18 and the surface 36. It will be appreciated by those skilled in the art that the ergonomic design of the grip 8 and the calibration head housing 2*a* of the calibration head 2 may render ease in control and positioning of the calibration head 2 during calibration of the pressure sensor 37. The LED(S) 14 may be energized to illuminate the interface between the calibration head 2 and the pressure sensor 37.

Power to the calibration head 2 and the control/power box 26 may be established by actuation of the power switch 29*f* (FIG. 2) on the front panel interface 28 of the power/control box 26. The switch 6 on the calibration head 2 may be actuated to establish power to the speaker 11 via the speaker circuitry 15 (FIG. 1). The switch 6 may additionally energize the LED(s) 14 (FIGS. 6 and 9) in the speaker housing 10 of the calibration head 2 to illuminate the mechanical interface between the sensor adaptor 18 and the pressure sensor 37.

On the power/control box 26, the calibration head indicators and controls 29 may be actuated to select the type of acoustic calibration signal 40 (such as tone or white noise, for example and without limitation) which is to be broadcasted from the speaker 11 of the calibration head 2 for calibration of the pressure sensor 37. The frequency adjustment knob 29*b* (FIG. 2) and the volume adjustment knob 29*c* may be adjusted to select the frequency and volume, respectively, of the acoustic calibration signal. Using feedback from the microphone 12, the control box 26 and the calibration head 2 may work together to drive the speaker 11 and set the sound pressure 68 (FIG. 9) generated by the acoustic calibration signal inside the housing opening 13 and the adaptor opening 19 (FIG. 9) to the selected level. In this manner, the pressure sensor 37 may be calibrated to the desired pressure level. The microphone 12 may provide a feedback signal 84 for adjustment of the speaker 11, as was set forth herein above with respect to FIG. 9B. The leak detection circuit 72 of the device 1 may have the ability to detect leakage in the seal 20 on the sensor adaptor 18 and provide visual feedback 94 to the operator to assist in appropriate application of the acoustic calibration signal 40 to the pressure sensor 37. Visual feedback 94 may be flashing LED(s) 14. As shown in FIG. 9B, in some embodiments, aural feedback 96 may be provided from a speaker 95 mounted in either the power/control box 26 or the calibration head 2, or both.

As illustrated in FIG. 9B, in implementation of the leak detection circuit 72, which may be provided in the power/control box 26, the speaker 11 may broadcast a reference signal 40*a* which may be received by the microphone 12. In response, the microphone 12 may transmit feedback 84 to the leak detection circuit 72. In the event that the reference signal 40*a* is out of range, indicating the presence of a leak in the calibration head 2, the leak detection circuit 72 may transmit an indication signal 86 to the calibration head indicators and controls 29. The leak detection circuit 72 may additionally transmit an activation signal 90 to the LED(s) 14 such that the LED(s) is/are illuminated, visually indicating that the reference signal 40*a* emitted by the speaker 11 is out of range. The calibration head indicators and controls 29 may be used to transmit a control signal 88 back to the speaker 11. The control signal 88 may cause the speaker 11 to broadcast a reference signal 40*a* the parameters of which are within the normal range for the calibration. In some embodiments, an automatic shutoff signal 92 may be transmitted from the leak detection circuit 92 to the speaker 11 in the event that the leak in the calibration head 2 persists for an extended period of time. This may prevent overdriving of and potential damage to the speaker 11. In some embodiments, aural feedback 96 may be provided from a speaker 95 mounted in either the power/control box 26 or the calibration head 2, or both.

Figure 9A:
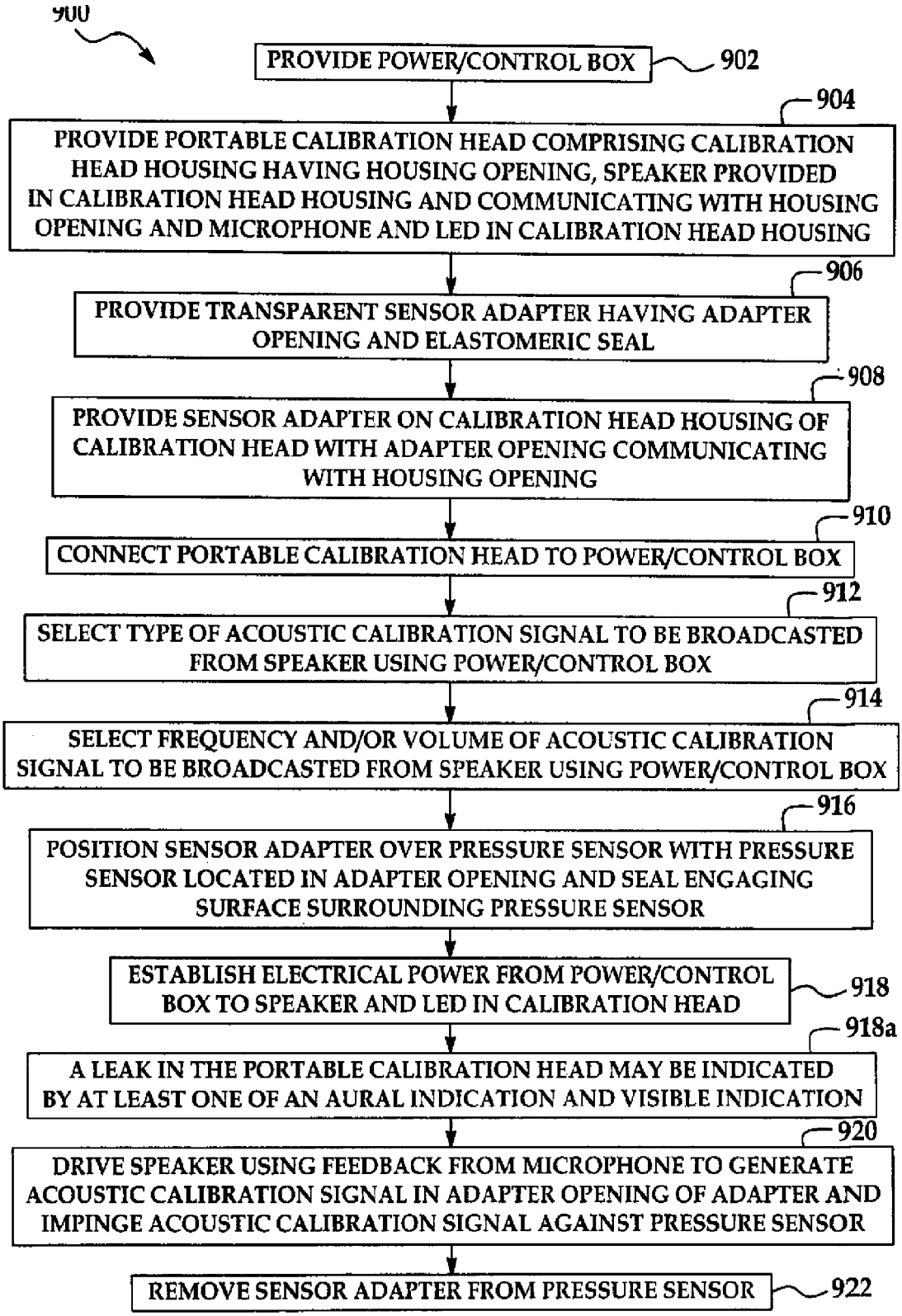
FIG. 9A is a flow diagram which illustrates an illustrative method of calibrating a pressure sensor while the pressure sensor is installed on a fixture.
Figure 9B:
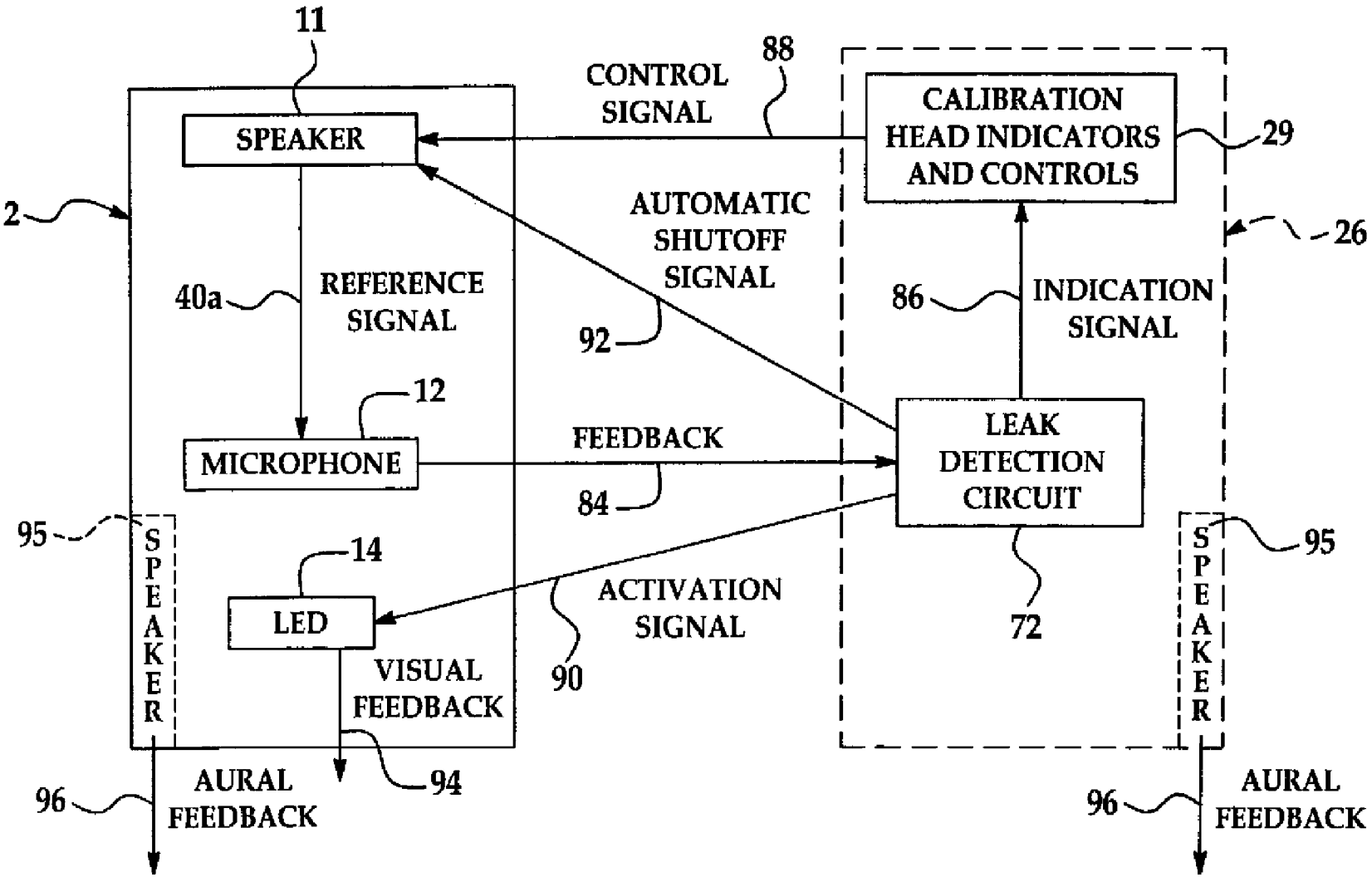
FIG. 9B is a block diagram which illustrates implementation of a leak detection circuit in an illustrative embodiment of the high intensity calibration device.

Referring next to FIG. 9A, a flow diagram 900 which illustrates an illustrative method of calibrating a pressure sensor while the pressure sensor is installed on a fixture is shown. In block 902, a power/control box may be provided. In block 904, a portable calibration head having a calibration head housing with a housing opening, a speaker provided in the calibration head housing and communicating with the housing opening and a microphone and LED in the calibration head housing may be provided. In block 906, a transparent sensor adaptor having an adaptor opening and an elastomeric seal may be provided. In block 908, the sensor adaptor may be provided on the calibration head housing of the calibration head with the adaptor opening communicating with the housing opening. In block 910, the portable calibration head may be connected to the power/control box and the power to the power/control box turned on. In block 912, the type of acoustic calibration signal to be broadcasted from the speaker may then be selected using the power/control box. In block 914, the frequency and/or volume of the acoustic calibration signal which is to be broadcasted from the speaker may be selected using the power/control box. In block 916, the sensor adaptor may be positioned over the pressure sensor with the pressure sensor located in the adaptor opening of the sensor adaptor and the seal of the sensor adaptor engaging the surface surrounding the pressure sensor. In block 918, electrical power from the power/control box to the speaker and the LED(s) in the calibration head may be established. A switch on the calibration head may be engaged to drive the speaker after a seal is established with the seal engaging surface. In block 918*a*, a leak in the portable calibration head may be indicated by at least one of an aural indication and a visible indication. In block 920, the speaker may be driven using feedback from a microphone to generate an acoustic calibration signal in an adaptor opening of the adaptor and the acoustic calibration signal may impinge against the pressure sensor. After calibration, the switch on the portable calibration head may be disengaged so that when the portable calibration head is subsequently removed from the seal engaging surface, the speaker of the portable calibration head is not driven with an unsealed cavity. In block 922, the sensor adaptor may be removed from the pressure sensor. Once the settings on the power/control box and the portable calibration head are established, an operator may move quickly from sensor to sensor re-engaging the speaker after positioning of the portable calibration head and disengaging the speaker before removing the portable calibration head.

Figure 10:
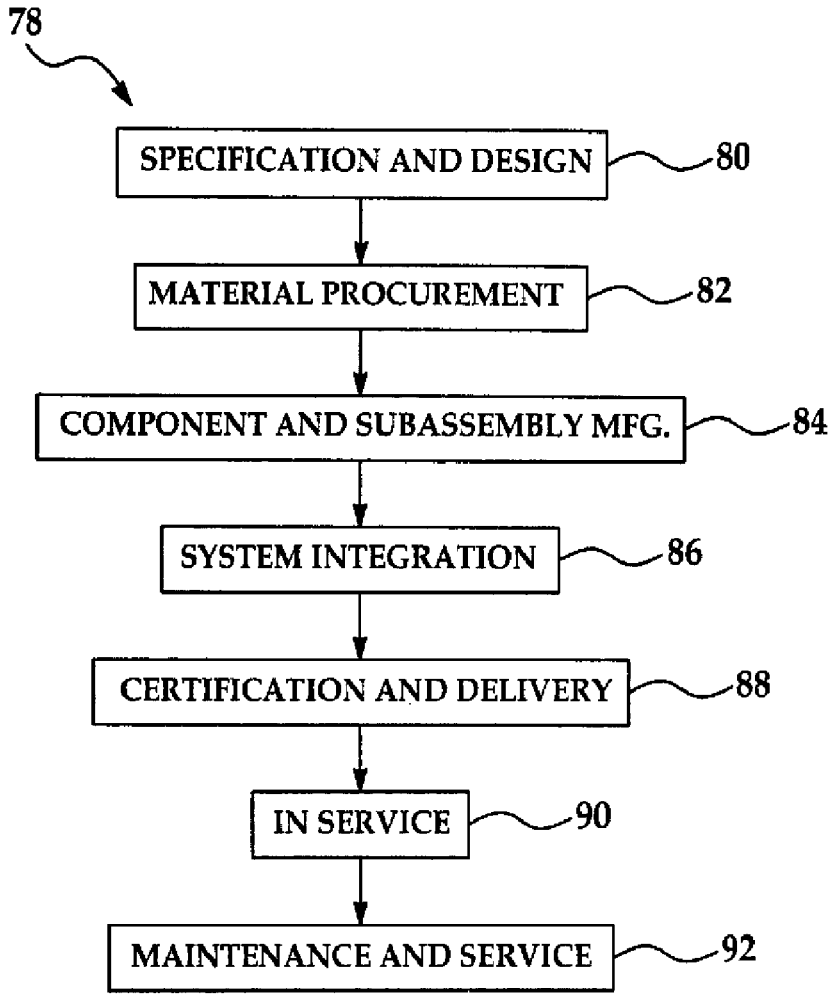
FIG. 10 is a flow diagram of an aircraft production and service methodology.
Figure 11:
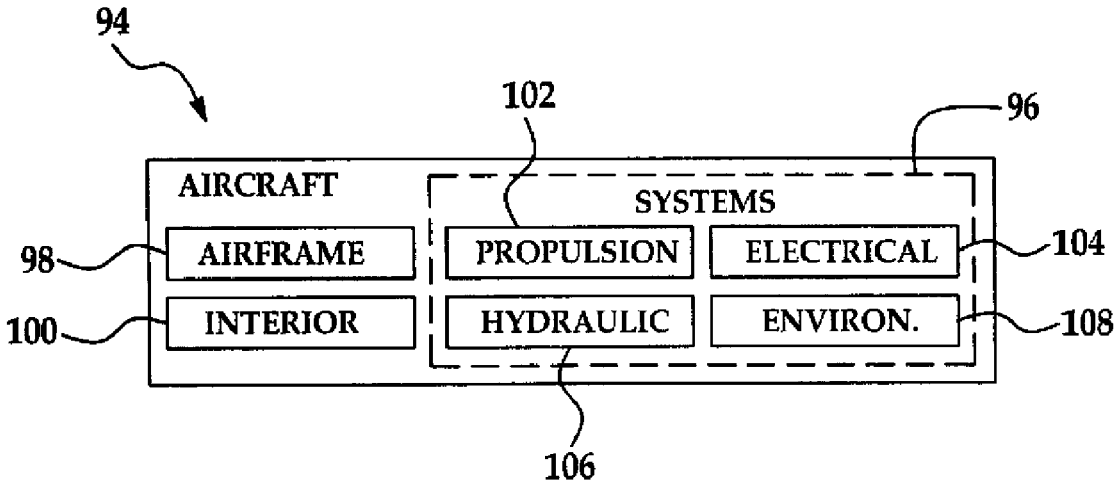
FIG. 11 is a block diagram of an aircraft.

Referring next to FIGS. 10 and 11, embodiments of the disclosure may be used in the context of an aircraft manufacturing and service method 78 as shown in FIG. 10 and an aircraft 94 as shown in FIG. 11. During pre-production, exemplary method 78 may include specification and design 80 of the aircraft 94 and material procurement 82. During production, component and subassembly manufacturing 84 and system integration 86 of the aircraft 94 takes place. Thereafter, the aircraft 94 may go through certification and delivery 88 in order to be placed in service 90. While in service by a customer, the aircraft 94 may be scheduled for routine maintenance and service 92 (which may also include modification, reconfiguration, refurbishment, and so on).

Each of the processes of method 78 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 11, the aircraft 94 produced by exemplary method 78 may include an airframe 98 with a plurality of systems 96 and an interior 100. Examples of high-level systems 96 include one or more of a propulsion system 102, an electrical system 104, a hydraulic system 106, and an environmental system 108. Any number of other systems may be included. Although an aerospace example is shown, the principles of the disclosure may be applied to other industries, such as the automotive industry.

The apparatus embodied herein may be employed during any one or more of the stages of the production and service method 78. For example, components or subassemblies corresponding to production process 84 may be fabricated or manufactured in a manner similar to components or subassemblies produced while the aircraft 94 is in service. Also, one or more apparatus embodiments may be utilized during the production stages 84 and 86, for example, by substantially expediting assembly of or reducing the cost of an aircraft 94. Similarly, one or more apparatus embodiments may be utilized while the aircraft 94 is in service, for example and without limitation, to maintenance and service 92.

Although the embodiments of this disclosure have been described with respect to certain exemplary embodiments, it is to be understood that the specific embodiments are for purposes of illustration and not limitation, as other variations will occur to those of skill in the art.

What is claimed is:

1. A calibration device, comprising:

a power/control box; and a portable calibration head disposed in electrical communication with said power/control box and comprising:

a calibration head housing having a housing opening;

a speaker provided in said calibration head housing and communicating with said housing opening; and wherein said power/control box is configured to induce emission of an acoustic calibration signal from said speaker of said calibration head.

2. The calibration device of claim 1 further comprising a sensor adaptor carried by said calibration head housing and having an adaptor opening communicating with said housing opening.

3. The calibration device of claim 2 wherein said sensor adaptor is interchangeable on said calibration head housing.

4. The calibration device of claim 2 wherein said sensor adaptor is transparent.

5. The calibration device of claim 2 further comprising an elastomeric seal carried by said sensor adaptor.

6. The calibration device of claim 5 further comprising a leak detection circuit provided in said power/control box and adapted to detect a leak in said elastomeric seal.

7. The calibration device of claim 6 wherein said leak detection circuit is adapted to indicate said leak in said elastomeric seal by at least one of an aural indication and a visible indication.

8. The calibration device of claim 1 wherein said acoustic calibration signal is selectable by type, level and frequency.

9. The calibration device of claim 1 further comprising a grip provided on said calibration head housing of said calibration head.

10. A calibration device, comprising:

a power/control box; and a portable calibration head disposed in electrical communication with said power/control box and comprising:

a calibration head housing having a generally cylindrical main housing, a generally tapered speaker housing extending from said main housing and a housing opening provided in said speaker housing;

a speaker provided in said speaker housing and communicating with said housing opening; and wherein said power/control box is configured to induce emission of an acoustic calibration signal from said speaker of said calibration head.

11. The calibration device of claim 10 further comprising a sensor adaptor carried by said calibration head housing and having an adaptor opening communicating with said housing opening.

12. The calibration device of claim 11 wherein said sensor adaptor is interchangeable on said calibration head housing.

13. The calibration device of claim 11 wherein said sensor adaptor is transparent.

14. The calibration device of claim 11 further comprising an elastomeric seal carried by said sensor adaptor.

15. The calibration device of claim 14 further comprising a leak detection circuit provided in said power/control box and adapted to detect a leak in said elastomeric seal.

16. The calibration device of claim 10 wherein said acoustic calibration signal is selectable by type, frequency and volume.

17. The calibration device of claim 10 further comprising a generally disc-shaped grip provided on said calibration head housing of said calibration head.

18. A method of calibrating a dynamic pressure transducer, comprising:

providing a power/control box;

providing a portable calibration head having a calibration head housing with a housing opening and a speaker provided in said calibration head housing and communicating with said housing opening;

connecting said portable calibration head to said power/control box;

placing said portable calibration head over a pressure sensor; and driving said speaker to generate an acoustic calibration signal in said portable calibration head and impinge said acoustic calibration signal against said dynamic pressure transducer.

19. The method of claim 18 further comprising providing a sensor adaptor having an adaptor opening communicating with said housing opening on said calibration head housing, and wherein said placing said portable calibration head over a pressure sensor comprises placing said sensor adaptor over said pressure sensor.

20. The method of claim 18 further comprising selecting a type of said acoustic calibration signal to be broadcasted from said speaker.

21. The method of claim 18 further comprising selecting at least one of a frequency and volume of said acoustic calibration signal to be broadcasted from said speaker.

22. The method of claim 18 further comprising indicating a leak in said portable calibration head by at least one of an aural indication and a visible indication.

23. A calibration device for calibrating a dynamic pressure transducer installed on a fixture, comprising:

a power/control box comprising:

a power box housing;

a front panel interface provided on said power box housing; and calibration head indicators and controls provided on said front panel interface and including a frequency adjustment knob and a volume adjustment knob;

a battery housing provided in said power box housing;

at least one battery provided in said battery housing and connected to said calibration head indicators and controls;

a power interface provided in said power box housing and electrically connected to said at least one battery; and a portable calibration head disposed in electrical communication with said calibration head indicators and controls of said power/control box and comprising:

a calibration head housing having a generally cylindrical main housing, a generally tapered speaker housing extending from said main housing and a housing opening provided in said speaker housing;

a speaker provided in said speaker housing and communicating with said housing opening;

a transparent sensor adaptor carried by said speaker housing and having an adaptor opening communicating with said housing opening;

an LED provided in said speaker housing and adapted to illuminate said sensor adaptor; and wherein said power/control box is configured to induce emission of an acoustic calibration signal from said speaker of said calibration head provide and selection of a signal type of said acoustic calibration signal responsive to actuation of said calibration head indicators and controls.

24. A method of calibrating a pressure sensor while the pressure sensor is installed on a fixture, comprising:

providing a power/control box;

providing a portable calibration head having a calibration head housing with a housing opening, a speaker provided in said calibration head housing and communicating with said housing opening and a microphone and an LED provided in said calibration head housing;

providing a transparent sensor adaptor having a sensor adaptor opening and an elastomeric seal on said calibration head housing of said calibration head with said sensor adaptor opening communicating with said housing opening;

connecting said portable calibration head to said power/control box;

positioning said sensor adaptor over a pressure sensor with said pressure sensor located in said adaptor opening and said seal engaging a surface surrounding said pressure sensor;

establishing electrical power from said power/control box to said speaker and said LED in said calibration head;

selecting a type of acoustic calibration signal to be broadcasted from said speaker using said power/control box;

selecting at least one of a frequency and a volume of an acoustic calibration signal to be broadcasted from said speaker using said power/control box;

driving said speaker using feedback from said microphone to generate an acoustic calibration signal in said adaptor opening of said adaptor and impinge said acoustic calibration signal against said pressure sensor; and removing said sensor adaptor from said pressure sensor.

* * * * *